United States Patent [19]

Robson

[11] Patent Number: 4,835,570

[45] Date of Patent: May 30, 1989

[54] APPARATUS FOR PRINTING FIXED AND VARIABLE INDICIA

[75] Inventor: Thomas Robson, Penfield, N.Y.

[73] Assignee: Xerox Corporation, Stamford, Conn.

[21] Appl. No.: 183,867

[22] Filed: Apr. 20, 1988

[51] Int. Cl.[4] ..... G03G 15/00; G03G 15/01; G03G 15/10

[52] U.S. Cl. ..... 346/160; 355/202; 355/272

[58] Field of Search ..... 355/7, 4, 3 R, 10, 14 R, 355/140; 118/645; 430/357

[56] References Cited

U.S. PATENT DOCUMENTS

| | | | |
|---|---|---|---|
| 4,124,286 | 11/1978 | Barasch | 355/3 R |
| 4,302,096 | 11/1981 | Schonfeld et al. | 355/43 |
| 4,578,689 | 3/1986 | Spencer et al. | 346/160 |
| 4,639,791 | 1/1987 | Masaki | 358/300 |
| 4,728,987 | 3/1988 | Diola et al. | 355/10 X |
| 4,761,669 | 8/1988 | Langdon | 355/10 X |
| 4,791,450 | 12/1988 | Mosehauer et al. | 355/7 X |
| 4,794,421 | 12/1988 | Stoudt et al. | 355/7 X |

OTHER PUBLICATIONS

Appln. Ser. No. 140,860, filed 01/04/88 to Man C. Tam et al. entitled "Imaging System".

*Primary Examiner*—A. C. Prescott

*Attorney, Agent, or Firm*—H. Fleischer; J. E. Beck; R. Zibelli

[57] ABSTRACT

An apparatus in which fixed and variable indicia are printed on a receiving member. One portion of a xeroprinting master has an imagewise pattern corresponding to the fixed indicia formed thereon. The xeroprinting master is uniformly charged and, the portion thereof having the imagewise pattern formed thereon, uniformly exposed to light energy. This records a fixed electrostatic latent image corresponding to the fixed indicia thereon. Another portion of the charged xeroprinting master is selectively exposed to light energy to record a variable electrostatic latent image corresponding to the variable indica thereon. The fixed and variable electrostatic latent images are developed, and the developed image is transferred to the receiving member to print the fixed and variable indicia thereon.

16 Claims, 2 Drawing Sheets

APPARATUS FOR PRINTING FIXED AND VARIABLE INDICIA

Figure 1:
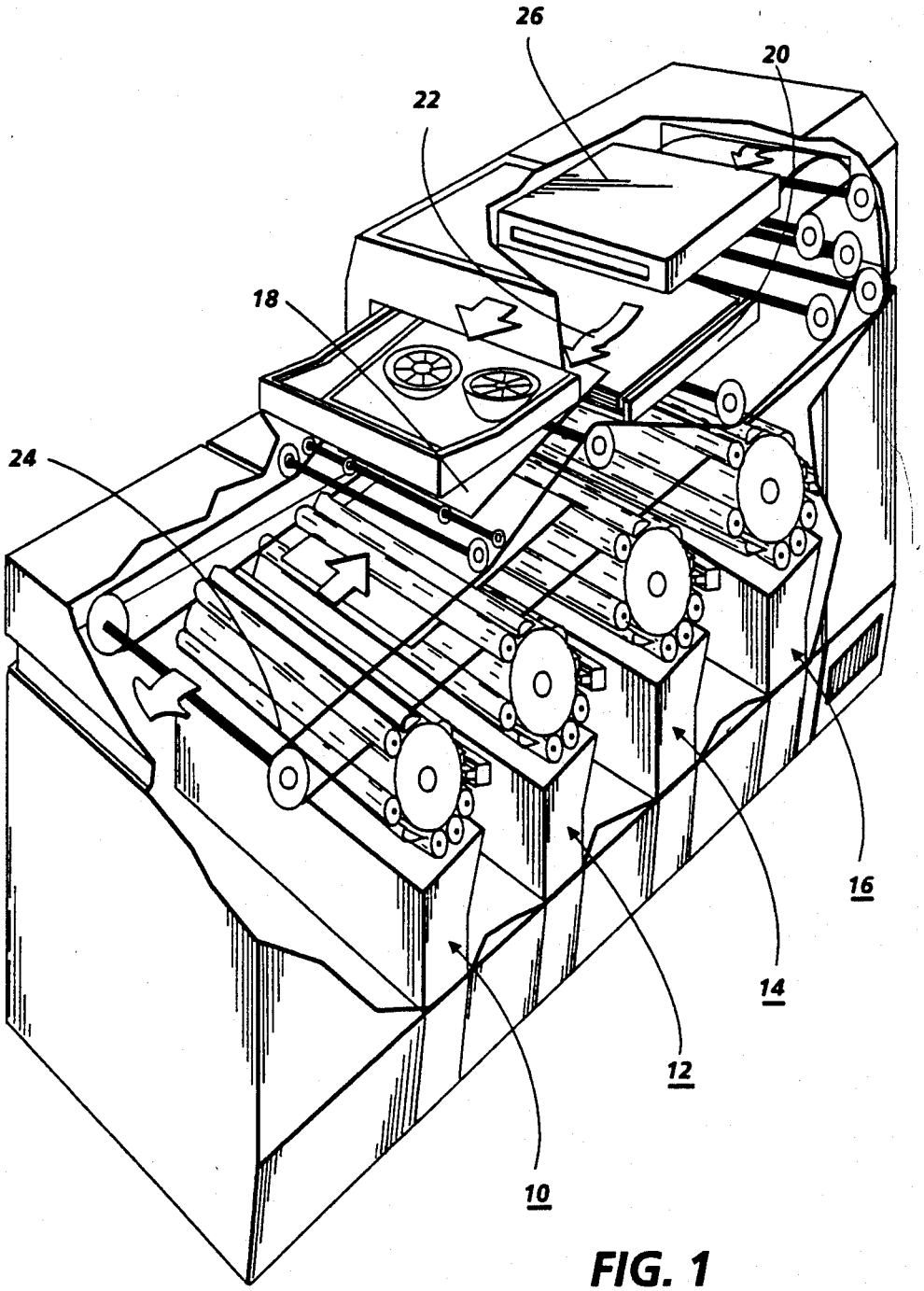

This invention relates generally to a printing system, and more particularly concerns an apparatus for printing fixed and variable indicia on a receiving member.

There are different printing processes which employ a moving master for transferring an image to a sheet of paper. One such technique is used to produce multiple color proof copies from halftone film separations. Initially, an electrostatic maser is exposed to a halftone film separation. This forms an electrostatic latent image on the master corresponding to the halftone film separation. Four masters are made. One of the masters corresponds to black with the other masters corresponding to single colors in the desired proof copy. The masters are then placed in the printing machine and secured to rotating cylinders. One master is mounted releasably on each cylinder. Each master is charged to a substantially uniform potential. The charge bleeds away, except in the image areas, to form an electrostatic latent image thereon corresponding to the image areas of the halftone film separation. The latent image is developed by bringing a liquid developer material into contact therewith. The liquid developer material comprises a liquid carrier having pigmented particles dispersed therein. The pigmented particules are deposited, in image configuration, on the master. These latent images are developed with developer material having a color corresponding to the subtractive primary of the color of the corresponding halftone film separation. Thereafter, the differently colored developed images are transferred from the masters to the sheet in superimposed registration with one another. heat is then applied to permanently fuse the image to the sheet so as to form a color proof copy.

In the art of printing, different approaches have been devised for preparing the masters for subsequent use in the printing process. Lithographic or offset printing is a well known and established printing process. In lithography, printing is from a plate which depends upon different inking properties of the imaged and non-imaged areas for printability. Typically, a lighographic intermediate is prepared on a silver halide film from an original. The plate is then contact exposed to intense ultra violet light through the intermediate. The exposed area of the plate becomes hydrophilic or ink receptive with the non-exposed area being washed away by a chemical treatment to become hydrophobic or ink repellant. Ink is then applied to the plate and the ink image is transferred to an offset roller for printing onto a sheet. Lithographic printing is expensive and time consuming, particularly in the formation of high quality color prints where several color separation images are superimposed on the sheet. The high cost and complexity associated with the preparation of expensive printing plates and press runs has resulted in color proofing being used to form representative interim prints or proofs from color separation components. This enables the operator to determine whether the prints are satisfactory. When the operator is satisfied with the results, a printing plate is prepared for each color separation component.

Another well known printing technique is electrophotographic printing. Generally, an electrostatic latent image is produced for each printing cycle by exposing a charged photoreceptor to an optically formed light image of an original document, or by laser scanning.

The electrostatic latent image is then developed with toner particles to form a toner powder image on the photoreceptor. The toner powder image is then transferred to a sheet and permanently fixed thereto. While electrophotographic printing is significantly simpler and less costly than lithographic or offset printing, it does not readily achieve the combined requirements of quality and speed necessary in high speed commercial printing machines. This is due, at least partially, to the requirement to record the electrostatic latent image for each printing cycle.

Another electrophotographic printing process, xeroprinting, overcomes the foregoing problem. In xeroprinting multiple copies are printed from a master. The master may be a metal sheet having an image in the form of a thin electrically insulating coating. The master has different charge acceptance in the imaged and non-imaged areas. Generally, the master has an electrically insulating pattern corresponding to the desired image, and electrically conductive areas corresponding to the background. The xeroprinting master is then uniformly charged. The charge remains trapped only on the insulating areas resulting in an electrostatic latent image. The latent image is developed and the toner powder image transferred to the sheet. After transfer of the toner powder image to the sheet, the xeroprinting master is cleaned and the process repeated. Thus, there is no need to have repetitive imagewise exposures for each printing cycle. However, it has been found that this printing technique did not produce prints having the required high quality. In addition, it is difficult to introduce new or different data in addition to the repetitive or fixed data during each printing cycle. Hence, it is desirable to both improve the quality of xeroprinting while simultaneously being capable of introducing new data during each printing cycle. Various approaches have been devised for printing fixed and variable data on a common sheet. The following disclosures appear to be pertinent:

U.S. Pat. No. 4,124,286
Patentee: Barasch
Issued: Nov. 7, 1978

U.S. Pat. No. 4,302,096
Patentee: Schonfeld et al.
Issued: Nov. 24, 1981

U.S. Pat. No. 4,578,689
Patentee: Spencer et al.
Issued: Mar. 25, 1986

U.S. Pat. No. 4,639,791
Patentee: Masaki
Issued: Jan. 27, 1987

Co-pending U.S. patent application Ser. No. 140,860

Applicant: Tam et al.
Filed: Jan. 4, 1988

The relevant portions of the foregoing disclosures may be briefly summarized as follows:

U.S. Pat. No. 4,124,286 discloses a method and apparatus for printing a composite record based upon first and second sources of information. The first source of information is imaged onto a photoconductive medium having the property of persistent conductivity to form a conductive image representative thereof. The conductive image is then transferred onto a second photoconductive medium in the form of an electrostatic latent image. The second source of information is imaged onto the second photoconductive medium by a scanning laser as an overlay on the image of the first source. The composite latent image is then developed and the developed image transferred onto a record medium.

U.S. Pat. No. 4,302,096 describes a graphic forms overlay apparatus using a sweeping laser beam and a moveable light sensitive medium to image data from a data processing source. A photoconductive drum stores a pattern of electrostatic charges which are created in response to illumination by a laser beam. A moveable forms drum is provided for mounting a graphic forms negative thereon. A light source illuminates the negative to produce a positive light image thereof which is then reflected by optical means onto a light sensitive printing member.

U.S. Pat. No. 4,578,689 discloses a dual mode laser printer which has a program controlled microprocessor to switch between a high resolution mode and a low resolution mode. A laser driver circuit receives a signal from an output logic circuit to modulate a laser diode. The laser light erases background areas when it is turned on and leaves black areas behind. The laser may also be used to write in the areas required for the image.

U.S. Pat. No. 4,639,791 describes an image overlay apparatus with elecronic image storage means capable of overlaying two images. A solid state image sensor, a CCD photoelectrically reads an original bearing information to be copied and a read only memory stores image information of a format to be synthesized with the original image. Serial image signals obtained by processing in a reader unit are supplied to a laser scanning optical system unit in the printer.

Co-pending U.S. patent application Ser. No. 140,860 discloses an imaging system having an imaging member made from a substrate and an electrically insulating softenable layer on the substrate. The softenable layer has migration marking material located near the surface of the softenable layer, spaced from the substrate. A charge transport material in the softenable is imaged by electrostatically charging the member and exposing the member to activating radiation in an imagewise pattern. The resistance to migration of the marking material in the softenable layer is decreased sufficiently to allow the migration of marking material struck by the activating radition to retain a slight net charge. This imaged member may be used as a xeroprinting master in a xeroprinting process wherein the master is initially uniformly charged, and, thereafter, uniformly exposed to form an electrostatic latent image. The latent image is developed and then transferred to a receiving member.

In accordance with one aspect of the present invention, there is provided an apparatus for printing fixed and variable indicia on a receiving member. The apparatus includes a xeroprinting master having an imagewise pattern corresponding to the fixed indicia formed on one portion thereof. Means deposit a substantially uniform charge on the surface of the xeroprinting master. Means are provided for substantially uniformly exposing the one portion of the charged surface of the xeroprinting master having the imagewise pattern formed thereon to light energy. This records a fixed electrostatic latent image on the surface of the xeroprinting master. Means selectively expose another portion of the charged surface of the xeroprinting master to light energy. This records a variable electrostatic latent image corresponding to the variable indicia on the surface of the xeroprinting master. Means develop the fixed electrostatic latent image and the variable electrostatic latent image recorded on the xeroprinting master with developer material. This forms a a developed image corresponding to the fixed elecrostatic latent image and the variable electrostatic latent image. Means are provided for transferring the developed image to the receiving member to print the fixed and variable indicia thereon.

Pursuant to another aspect of the present invention, there is provided a printing machine of the type in which fixed and variable different color indicia are formed on a receiving member. The printing machine includes a plurality of xeroprinting masters. Each one of the plurality of xeroprinting masters have an imagewise pattern corresponding to the fixed indicia formed on one portion thereof. Means are provided for depositing a substantially uniform charge on the surface of each one of the plurality of xeroprinting masters. Means substantially uniformly expose the portion of the charged surface of each one of the plurality of xeroprinting masters having the imagewise patterns formed thereon to light energy to record fixed electrostatic latent images on the surfaces of each one of the plurality of xeroprinting masters. Means selectively expose another portion of the charged surface of each one of the plurality of xeroprinting masters to light energy to record variable electrostatic latent images corresponding to the variable indicia on the surfaces of each one of the plurality of xeroprinting masters. Means develop the fixed electrostatic latent image and the variable electrostatic latent image recorded on each one of the plurality of xeroprinting masters with different color developer material to form different color developed images on each one of the plurality of xeroprinting masters. Means transfer the different color developed images from each one of the plurality of xeroprinting masters to the receiving member in superimposed registration with one another to print fixed and variable color indicia thereon.

Figure 2:
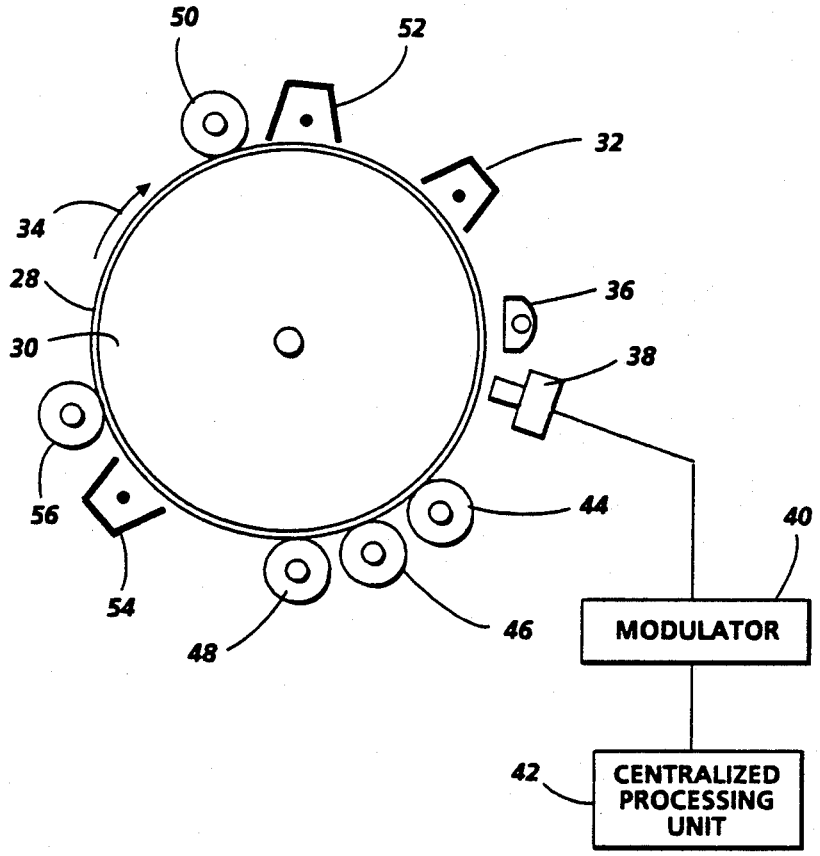

Other aspects of the present invention will become apparent as the following description proceeds and upon reference to the drawings, in which:

FIG. 1 is a schematic, perspective view showing an illustrative printing machine incorporating the features of the present invention therein; and FIG. 2 is a schematic, elevational view depicting one of the printing modules used in the FIG. 1 printing machine.

While the present invention will hereinafter be described in conjunction with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Turning now to FIG. 1, the printing machine employs four printing modules, indicated generally by the reference numerals 10, 12, 14, and 16. Each printing module is substantially identical to one another with the only distinction being the color of the developer material. Printing module 10 employs a yellow developer material, printing module 12 a magenta developer material, printing module 14 a cyan developer material, and printing module 16 a black developer material. In operation, a discrete xeroprinting master sheet is formed for each printing module. Preferably, each one of the xeroprinting masters is made from a substrate having a conductive layer, a charge transport spacing layer including a film forming polymer and a charge transport material, and a softenable layer coated thereon. The softenable layer includes a charge transport material and a fracturable layer of migration marking material contiguous with the upper surface of the softenable layer. The supporting substrate may be either electrically insulating or electrically conductive. Another multilayered overcoated embodiment of a xeroprinting master includes a substrate having a conductive coating, an adhesive layer, and a charge transport layer with a softenable layer coated thereon. The migration marking material is initially arranged in a fracturable layer contiguous with the upper surface of the softenable material layer. Alternatively, the xeroprinting master may merely include a supporting substrate, a conductive layer, and a softenable layer coated thereon. The migration marking material is initially arranged in a fracturable layer contiguous with the upper surface of the softenable material layer. The xeroprinting master is uniformly charged by a corona generating device. Thereafter, the uniformly charged xeroprinting master is imagewise exposed to activating illumination. The light exposed xeroprinting master is then exposed to solvent vapor. Heat energy is then applied to the solvent treated xeroprinting master and the process for forming the elecrostatic latent image thereon is completed. The process for manufacturing and the structure of the foregoing xeroprinting master is more fully described in co-pending U.S. patent application Ser. No. 140,860 filed Jan. 4, 1988, the relevant portions thereof being hereby incorporated into the present application. After the electrostatic latent images are formed on each of the xeroprinting masters, the master sheets are taken to the printing machine and loaded onto the drum of the appropriate printing module.

With continued reference to FIG. 1, after the master sheets are loaded in their respective printing modules, the printing machine is actuated to print the color proof. Upon energization of the printing machine, a receiving member or sheet of support material 18 is advanced from tray 20. The sheet of support material may be made from any suitable material, e.g. plain paper. A sheet feeder separates and advances the uppermost sheet from a stack of sheets in tray 20. The sheet moves in the direction of arrow 22 to a transport 24. Transport 24 advances the sheet to successive printing modules. The master sheet, in each printing module, is developed with a different color liquid developer material. The differently colored developed images on each master sheet are transferred to sheet 18 in superimposed registration with one another to form a multicolor image thereon. Inasmuch as the printing modules are substantially identical to one another, only printing module 10 will be described in detail hereinafter with reference to FIG. 2. After all of the developed images have been transferred to sheet 18, transport 24 advances sheet 18 through fuser 26. Fuser 26 radiantly heats the sheet having the liquid images transferred thereto. The fuser supplies sufficient heat to dry and permanently affix the transferred image to sheet 18 forming the desired color print. After fusing, the completed color print is advanced to a tray for subsequent removal from the printing machine by the operator.

One skilled in the art will appreciate that although the developer material has been described herein as being a liquid, a dry developer material including carrier granules having toner particles adhering triboelectrically thereto may also be used.

It is believed that the foregoing description is sufficient for purposes of the present application to illustrate the general operation of a printing machine incorporating the features of the present invention therein.

Turning now to FIG. 2, there is shown further details of printing module 10. As shown thereat, a xeroprinting master sheet 28 is secured releasably to drum 30. During the first cycle, a corona generating device, indicated generally by the reference numeral 32, uniformly and positively charges xeroprinting master sheet 28. As drum 30 rotates xeroprinting master sheet 28 in the direction of arrow 34, the charged xeroprinting master sheet 28 is then uniformly flash exposed to light energy by flash lamp 36. The uniform exposure to light energy causes portions of xeroprint master sheet 28 to discharge substantially and other portions thereof to discharge to a substantially lesser extend forming an electrostatic latent image on the xeroprinting master sheet corresponding to the fixed indicia. Next, other uniformly charged regions, not uniformly illuminated by flash lamp 36, of xeroprinting master sheet 28 are selectively exposed by a modulated laser beam from scanning laser unit 38. A modulator unit 40, coupled to scanning laser unit 38, receives an input from an informational source which, for example, may be a centralized processing unit 42, and modulates the laser beam of the scanning laser 38 to define an image representing the variable indicia. By way of example a green helium neon laser is suitable for operation in this manner. One skilled in the art will recognize that any suitable scanning unit may be used in this capacity. For example, a suitable scanning laser unit and modulator unit are described in U.S. Pat. No. 4,124,286 issued to Barasch on Nov. 7, 1978, the relevant portions thereof being hereby incorporated into the present application. The laser beam exposes selected portions of the uniformly charged xeroprinting master sheet to record the variable elecrostatic latent image thereon. In this manner, both a fixed electrostatic latent image and a variable electrostatic latent image are recorded on xeroprinting master sheet 28. Next, developer rolls 44 and 46 advance yellow liquid developer material into contact with master sheet 28. The yellow liquid developer includes a clear carrier and yellow colored toner. In this way, liquid developer material is brought into contact with the fixed and variable electrostatic latent images formed on xeroprinting master sheet 28. The toner is attracted electrostatically to the image areas forming a yellow image on xeroprinting master sheet 28. Preferably, the developer material includes a clear liquid insulating carrier having pigmented particles, i.e. toner particles dispersed therein. A suitable clear insulating liquid carrier may be made from aliphatic hydrocarbon, such as an Isopar, which is a trademark of the Exxon Corporation, having a low boiling point. The toner particles include a pigment associated with a polymer. A suitable liquid developer material is described in U.S. Pat. No. 4,582,774, issued to Landa in 1986, the relevant portions thereof being incorporated into the present application. Metering roll 48 controls the quality of developer material deposited on xeroprinting master sheet 28 and removes the excess therefrom. After the fixed and variable electrostatic latent images on xeroprinting master sheet 28 have been developed, drum 30 rotates the developed image to electrically biased roll 50 and corona generator 52. Receiving member or sheet 18 (FIG. 1) is interposed between xeroprinting master sheet 28 and roll 50. Transport 24 interposes sheet 18 between corona generator 52 and xeroprinting master sheet 28. Roll 50 is electrically biased to a suitable magnitude and polarity to tack sheet 18 to master sheet 28. Corona generator 52 sprays ions onto the backside of sheet 18 to attract the developed image from xeroprinting master sheet 28 thereto. After the developed image has been transferred to sheet 18, the xeroprinting master sheet passes through the next cycle, i.e. a cleaning cycle, and sheet 18 advances to the next printing module. During the first cycle, corona generator 54 and cleaning roll 56 are non-operative. In contradistinction, corona generator 54 and cleaning roll 56 are operative during this cleaning cycle with corona generators 32 and 52, developer rolls 44 and 46, and metering roll 48 being non-operative. Corona generator 54 sprays ions onto xeroprinting master sheet 28 to neutralize the residual charge thereon. In this manner, any residual variable electrostatic latent image is removed therefrom without effecting the imagewise pattern corresponding to the fixed indicia formed in the xeroprinting master sheet. Thus, during the next printing cycle new variable indicia may be added to the fixed indicia. Cleaning roller 56 scribs the surface of master sheet 28 clean. To assist in this action, liquid carrier may be fed onto the surface of cleaning roller 56. Preferably, the cleaning fluid is the carrier of the liquid developer material, i.e. a clear low boiling point aliphatic hydrocarbon, such as an Isopar, which is a trademark of the Exxon Corporation.

In recapitulation, it is clear that the apparatus of the present invention prints fixed and variable indicia on a sheet. A xeroprinting master having an imagewise pattern corresponding to the fixed indicia is uniformly charged and uniformly exposed to light energy. This records a fixed electrostatic latent image corresponding to the fixed indicia on the xeroprinting master. A non-exposed portion of the uniformly charged xeroprinting master is then selectively discharged to record a variable electrostatic latent image corresponding to the variable indicia. Thereafter, the fixed and variable electrostatic latent images are developed to form a developed image on the xeroprinting master. The developed image is then transferred from the xeroprinting master to the sheet to print the fixed and variable indicia thereon.

It is, therefore, evident that there has been provided in accordance with the present invention, an apparatus that fully satisfies the aims and advantages heretofore mentioned. While this invention has been described in conjunction with a preferred embodiment, it is evident that many alternatives, modifications and variations will be apparent to those skilled in the art. Accordingly, it is intended to embrace all such alternatives, modifications and variations that fall within the spirit and broad scope of the appended claims.

I claim:

1. An apparatus for printing fixed and variable indicia on a receiving member, including:

a xeroprinting master having an imagewise pattern corresponding to the fixed indicia formed on one portion thereof;

means for depositing a substantially uniform charge on the surface of said xeroprinting master;

means for substantially uniformly exposing the one portion of the charged surface of said xeroprinting master having the imagewise pattern formed thereon to light energy to record a fixed electrostatic latent image on the surface of said xeroprinting master;

means for selectively exposing another portion of the charged surface of said xeroprinting master to light energy to record a variable electrostatic latent image corresponding to the variable indicia on the surface of said xeroprinting master;

means for developing the fixed electrostatic latent image and the variable electrostatic latent image recorded on said xeroprinting master with developer material to form a developed image corresponding to the fixed electrostatic latent image and the variable electrostatic latent image; and means for transferring the developed image to the receiving member to print the fixed and variable indicia thereon.

2. An apparatus according to claim 1, wherein said selective exposing means includes:

a laser beam; and means for modulating said laser beam.

3. An apparatus according to claim 2, wherein said charge depositing means includes a corona generator.

4. An apparatus according to claim 3, wherein said uniform exposing means includes a light source for flash exposing the one portion of the charged surface of said xeroprinting master having the imagewise pattern formed thereon.

5. An apparatus according to claim 4, wherein said xeroprinting master includes:

a conductive layer;

a softenable layer coated on said conductive layer; and migration marking material arranged in a fracturable layer contiguous with the upper surface of said softenable layer.

6. An apparatus according to claim 4, wherein said developing means develops the fixed electrostatic latent image and the variable electrostatic latent image recorded on said xeroprinting master with a liquid developer material.

7. An apparatus according to claim 4, wherein said developing means develops the fixed electrostatic latent image and the variable electrostatic latent image recorded on said xeroprinting master with a dry developer material.

8. A printing machine of the type in which fixed and variable different color indicia are formed on a receiving member, including:

a plurality of xeroprinting masters with each one of said plurality of xeroprinting masters having an imagewise pattern corresponding to the fixed indicia formed on one portion thereof;

means for depositing a substantially uniform charge on the surface of each one of said plurality of xeroprinting masters;

means for substantially uniformly exposing the one portion of the charged surface of each one of said plurality of xeroprinting masters having the imagewise patterns formed thereon to light energy to record a fixed electrostatic latent image on the surfaces of each one of said plurality of xeroprinting masters;

means for selectively exposing another portion of the charged surface of each one of said plurality of xeroprinting masters to light energy to record a variable electrostatic latent image corresponding to the variable indicia on the surface of each one of said plurality of xeroprinting masters;

means for developing the fixed electrostatic latent image and the variable electrostatic latent image recorded on each one of said plurality of xeroprinting masters with different color developer material to form different color developed images on each one of said plurality of xeroprinting masters; and means for transferring the different color developed images from each one of said plurality of xeroprinting masters to the receiving member in superimposed registration with one another to print fixed and variable color indicia thereon.

9. A printing machine according to claim 8, wherein said selective exposing means includes:

a plurality of laser beams with one of said plurality of laser beams being associated with each one of said plurality of xeroprinting masters; and means for modulating each one of said plurality of laser means.

10. A printing machine according to claim 9, wherein said charge depositing means includes a corona generator.

11. A printing machine according to claim 10, wherein said uniform exposing means includes a plurality of light sources with at least one of said plurality of light sources being associated with each one of said plurality of xeroprinting masters for flash exposing the one portion of the charged surface of each one of said plurality of xeroprinting masters having the imagewise pattern formed thereon.

12. A printing machine according to claim 11, wherein each one of said plurality of xeroprinting masters includes:

a conductive layer;

a softenable layer coated on said conductive layer; and migration marking material arranged in a fracturable layer contiguous with the upper surface of said softenable layer.

13. A printing machine according to claim 11, wherein said developing means develops the fixed electrostatic latent image and the variable electrostatic latent image recorded on each one of said plurality of xeroprinting masters with a liquid developer material.

14. A printing machine according to claim 11, wherein said developing means includes:

a first developer unit for developing the fixed electrostatic latent image and the variable electrostatic latent image recorded on a first one of said plurality of xeroprinting masters with a yellow colored liquid developer material;

a second developer unit for developing the fixed electrostatic latent image and the variable elecrostatic latent image recorded on a second one of said plurality of xeroprinting masters with a magneta colored liquid developer material; and a third developer unit for developing the fixed electrostatic latent image and the variable electrostatic latent image recorded on a third one of said plurality of xeroprinting masters with a cyan colored liquid developer material.

15. A printing machine according to claim 11, wherein said developing means develops the fixed electrostatic latent image and the variable electrostatic latent image recorded on each one of said plurality of xeroprinting masters with a dry developer material.

16. A printing machine according to claim 15, wherein said developing means includes:

a first developer unit for developing the fixed electrostatic latent image and the variable electristatic latent image recorded on a first one of said plurality of xeroprinting masters with a yellow colored dry developer material;

a second developer unit for developing the fixed electrostatic latent image and the variable electrostatic latent image recorded on a second one of said plurality of xeroprinting masters with a magneta colored dry developer material; and a third developer unit for developing the fixed electrostatic latent image and the variable electrostatic latent image recorded on a third one of said plurality of xeroprinting masters with a cyan colored dry developer material.

* * * * *